United States Patent [19]

Wulc

[11] 4,430,814

[45] Feb. 14, 1984

[54] FABRIC TENSIONING ROLLER

[75] Inventor: Stanley S. Wulc, Rydal, Pa.

[73] Assignee: Stretch Devices, Inc., Philadelphia, Pa.

[21] Appl. No.: 316,590

[22] Filed: Oct. 30, 1981

[51] Int. Cl.[3] ..... D06C 3/08

[52] U.S. Cl. ..... 38/102.91; 101/127.1; 160/378

[58] Field of Search ..... 38/102.91, 102.1, 102.3, 38/102.4; 101/127.1, 128, 128.1; 160/378, 395, 397

[56] References Cited

U.S. PATENT DOCUMENTS

| | | | |
|---|---|---|---|
| 3,126,332 | 3/1964 | Salete | 160/378 X |
| 3,601,912 | 8/1971 | Dubbs | 101/127.1 X |
| 3,811,454 | 5/1974 | Huddle | 160/395 X |
| 4,112,643 | 9/1978 | Decker | 160/395 |
| 4,345,390 | 8/1982 | Newman | 38/102.91 |

FOREIGN PATENT DOCUMENTS

| | | | |
|---|---|---|---|
| 45355 | 12/1888 | Fed. Rep. of Germany | 160/395 |

*Primary Examiner*—Werner H. Schroeder
*Assistant Examiner*—Andrew M. Falik
*Attorney, Agent, or Firm*—Seidel, Gonda & Goldhammer

[57] ABSTRACT

A fabric tensioning roller has a longitudinally extending channel within which is disposed a fabric holder. A threaded member on the roller is connected to the fabric holder for selectively moving the fabric holder relative to the roller in a direction perpendicular to the longitudinal axis of the roller for fabric repositioning at selected locations along the roller.

10 Claims, 3 Drawing Figures

FIG. 1
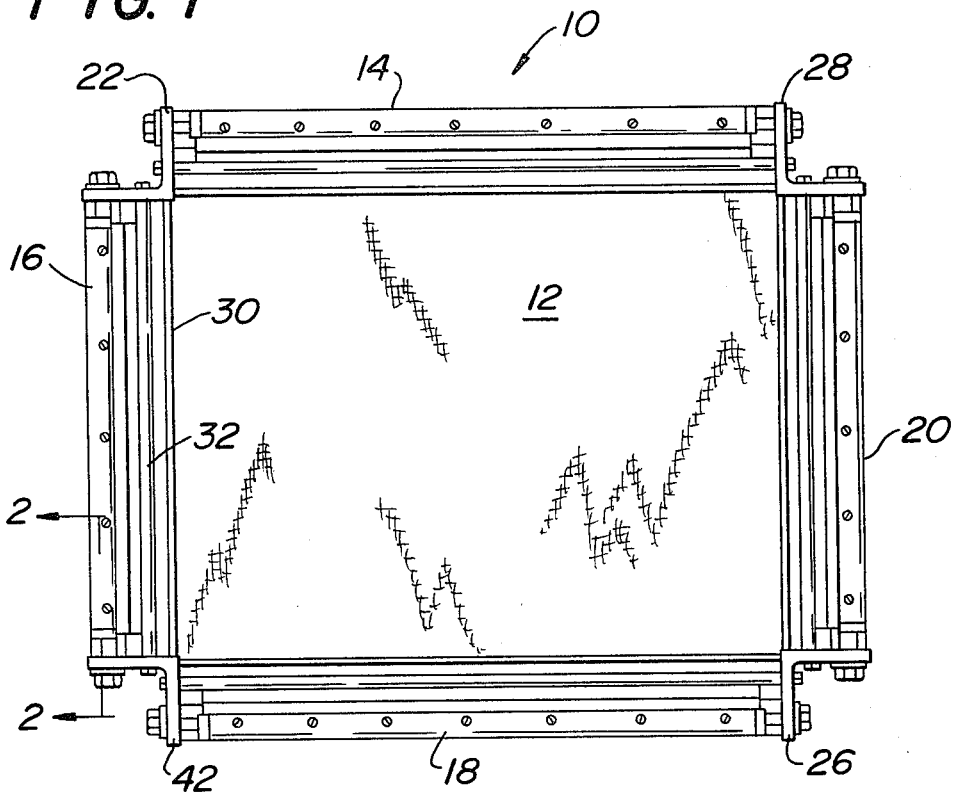
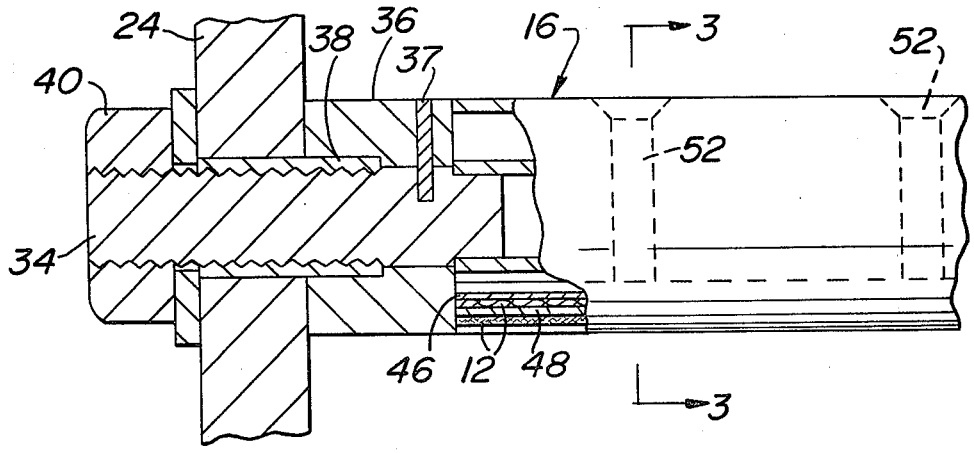
FIG. 2

FABRIC TENSIONING ROLLER

BACKGROUND

The present invention is an improvement over the roller in U.S. Pat. No. 3,908,293 and the roller in pending Application Ser. No. 206,213 filed on Nov. 13, 1980 U.S. Pat. No. 4,345,390 by Don. E,. Newman and entitled Screen Tensioning And Printing Frame.

In the above-mentioned patent and pending application, there is disclosed a screen tensioning roller which is rotatable relative to a frame for tensioning an entire edge portion of a fabric. I have found that ocassionally there is a need for repositioning of a small portion of the fabric or image at selected locations along the roller to compensate for errors usually unrelateds to fabric tension. Such compensations are often required because of defects, mistakes, substrate changes, or requirement changes in some other portion or portions of the manufacturing operation with which the printing is associated. The present invention is based on a recognition of that need and is directed to a solution of the problem of how to attain localized repositioning of the fabric or image.

SUMMARY OF THE INVENTION

The present invention is a fabric tensioning device in the form a roller having a longitudinally extending peripheral channel. A fabric holder is disposed in the channel. A means is provided on the roller for selectively moving a portion of the fabric holder relative to the roller in a direction perpendicular to the longitudinal axis of the roller for fabric repositioning at selected locations along the roller.

It is an object of the present invention to provide a screen tensioning roller which facilitates selective repositioning of a fabric at spaced locations along the roller.

Other objects and advantages of the present invention will appear hereinafter.

For the purpose of illustrating the invention, there is shown in the drawing a form which is presently preferred; it being understood, however, that this invention is not limited to the precise arrangements and instrumentalities shown.

FIG. 1 is a top plan view of a screen tensioning frame incorporating the present invention.

FIG. 2 is a sectional view taken along the line 2—2 in FIG. 1 but on an enlarged scale.

DETAILED DESCRIPTION

Figure 3:
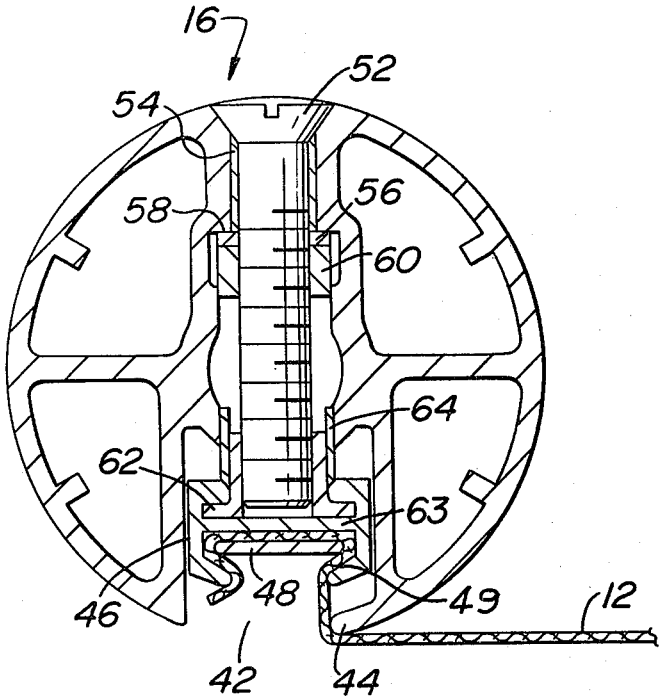
FIG. 3 is a sectional view taken along the line 3—3 in FIG. 2 but on an enlarged scale.

Referring to the drawing in detail, wherein like numerals indicate like elements, there is shown in FIG. 1 the screen tensioning and printing frame 10. A screen fabric 12 is applied to one face of the frame 10 in a manner to be described in detail hereinafter.

The frame 10 has as it main structural element a plurality of rollers 14 and 18 parallel to each other and rollers 16 and 20, parallel to each other. Roller 14 is mutually perpendicular with respect to rollers 16 and 20. The rollers 14, 16, 18, and 20 are rotatably supported at their ends by generally L-shaped corner members 22, 24, 26 and 28. Each roller has associated with it a dam member 30 and a beam 32 for preventing inward bowing of the roller.

The rollers are identical. Hence, only roller 16 will be described in detail. Roller 16 is preferably a hollow cylindrical roller made from a lightweight, noncorrosive material such as aluminum but may be made from other material such as steel. Roller 16 need not be cylindrical but may have other cross-sectional contours. The corners members such as member 24 are rigid members made from a lightweight, noncorrosive material such as aluminum but may be made from other materials such as steel. As shown more clearly in FIG. 2, a discrete threaded stud 34 is preferably threaded or force-fit into each end of a center bore of the roller 16 or otherwise secured thereto. Stud 34 has an annular shoulder abutting an end face of the roller 16. Stud 34 extends through a center bore in a hexagon nut 36 for affecting rotation of the roller 16 relative to the frame 24. A threaded sleeve 38 on the stud 34 abuts an annular shoulder on the nut 36 and constitutes a bearing for the portion of the stud 34 extending through the frame member 24. Sleeve 38 holds nut 36 against an end face of the tube 16. A tightening nut 40 is threaded to the free end of the stud 34. Nut 36 is secured to stud 34 in any convenient manner such as by the pin 37.

As shown more clearly in FIG. 3, the roller 16 has a longitudinally extending periphery channel 42 preferably open at the ends. The roller 16 has a peripheral lip 44 along one side of the channel for contact with the fabric 12. Within the channel 42 there is provided a fabric holder 46. Holder 46 is constructed of metal having a high bending strength and preferably in transverse section resembles an I-beam. The fabric 12 is adapted to have one of its edge portions clamped to one side of the central web 63 of holder 46, and retained thereon, by a retainer 48. When tension is applied to the fabric 12, retainer 48 cocks into the corner opposite the inclined surface 49 and is retained by surface 49.

At spaced points along its length, the roller 16 is provided with an adjusting means for selectively moving a portion of the fabric holder 46 in a direction perpendicular to the longitudinal axis of the roller 16 for tensioning of the fabric 12 at selective locations along the roller 16. Such adjusting means preferably includes a plurality of screws 52 which have their longitudinal axes perpendicular to the longitudinal axis of the roller 16. The screws 62 are preferably disposed along a diameter the roller 16 with their heads recessed inwardly of the outer periphery of roller 16 as shown more clearly in FIG. 3. A sleeve spacer 54 surrounds the shank of the screw 52 adjacent to the head an extends to a washer 56 resting on the shoulder 58. A round slotted nut 60 is threaded to the shank of the screw 52 and abuts the washer 56. Hence, screw 52 can rotate but cannot move axially.

A T-but 62 has its head disposed within the slot of the holder 46 on the opposite side of the center web from the retainer 48. The screw 52 at its terminal end is threaded to the nut 62. When the OD of the shank of nut 62 is less than OD of nut 60, said shank is preferably surrounded by a sleeve 62 so as to prevent direct contact with the body of the roller 16. The exposed end of the screw 52 has a screwdriver slot. When the screw 52 is rotated in one direction, the adjacent portion of holder 46 will move radially outwardly in a direction perpendicular to the longitudinal axis of the roller 16. When the screw 52 is rotated in an opposite direction, the adjacent portion of holder 46 will move radially inwardly. The extent of any such movement is limited by the yield point of the metal from which holder 46 is made. Any one of the screws 52 may be separately adjusted so as to provide selective repositioning of the fabric or image.

The roller 16 is symmetrical and uniform in section along its length. Hence, the roller 16 is readily manufactured by being extruded in the hollow shape as shown in FIG. 3. Thereafter, the roller 16 is transversly bored to provide the holes for the screws 52 and the sleeves and nuts described therewith. The holder 46 is also longitudinally slidable in the channel 42 relative to each of the T-nuts 62. The spacing between adjacent screws 52 may be varied as desired depending upon the length of the roller. For example, when roller 16 has a length of five feet, the screws 52 may be placed at six inch intervals. Such dimensions are by way of illustration rather than by way of limitation. Thus, it will be seen that the roller 16 may be rotated to tension the entire edge portion of the fabric by applying a wrench to the nut 36 and/or the fabric may be selectively repositioned at the location of one or more screws 52 along the length of the roller 16.

The present invention may be embodied in other specific forms without departing from the spirit or essential attributes thereof and, accordingly, reference should be made to the appended claims, rather than to the foregoing specification, as indicating the scope of the invention.

I claim:

1. A fabric tensioning device comprising a roller having a longitudinally extending peripheral channel, a discrete fabric holder in said channel, said fabric holder having an opening on one side which is exposed in said channel and adapted to receive and grasp an edge portion of fabric, first means on the roller and connected to the opposite side of said fabric holder for selectively moving a portion of the fabric holder relative to the roller in a direction perpendicular to the longitudinal axis of the roller for image or fabric repositioning at preselected locations along the roller, and second means facilitating movement of the fabric holder longitudinally in said channel relative to said first means whereby additional image or fabric repositioning can be effected.

2. A device in accordance with claim 1 wherein said fabric holder in transverse section simulates an I-beam, a fabric retainer member juxtaposed to a center web of said beam.

3. A device in accordance with claim 1 wherein said first means for moving the fabric holder includes a plurality of screws each threadedly coupled to a discrete member supported by said holder.

4. A device in accordance with claim 3 wherein said holder is slidable with respect to said screws and coupling members in said direction parallel to the longitudinal axis of said roller.

5. A device in accordance with claim 4 wherein said screws lie along a diameter of said roller and have a length greater than a radius of the roller but shorter than a diameter of the roller.

6. A device in accordance with claim 1 including a threaded stub shaft extending from each end of the roller, a discrete nut surrounding each shaft, a discrete sleeve threaded to each shaft and abutting a side face of one of the nuts for retaining its associated nut in engagement with an end face of the roller.

7. A device in accordance with claim 1 wherein said holder has a central web generally perpendicular to the longitudinal axes of said threaded members of said first means, each threaded member being coupled to said fabric holder on one side of said web, a fabric retainer on the other side of said web and supported by said fabric holder.

8. A device in accordance with claim 1 including four corners members, four of said rollers, each leg of each corner member supporting one end of each roller, each roller being parallel to one other roller and perpendicular to the remaining two rollers.

9. A device in accordance with claim 8 including four dam members supported by said corner members, each dam member being generally parallel to one of said rollers and inwardly thereof.

10. A device in accordance with claim 1 including at least one nut at an end of said roller for rotating the roller about its axis.

* * * * *